US006007002A

United States Patent [19]

Huber

[11] Patent Number: 6,007,002

[45] Date of Patent: Dec. 28, 1999

[54] HAND-HELD SHOWER

[75] Inventor: Roland Huber, Henschiken, Switzerland

[73] Assignee: Hansa Metallwerke AG, Germany

[21] Appl. No.: 08/611,102

[22] Filed: Mar. 5, 1996

[30] Foreign Application Priority Data

Mar. 10, 1995 [DE] Germany ..... 195 08 638

[51] Int. Cl.[6] ..... B05B 7/02

[52] U.S. Cl. ..... 239/525; 239/530; 239/548; 285/319

[58] Field of Search ..... 239/525, 530, 239/587.1, 548; 138/109; 285/319, 272, 282, 184

[56] References Cited

U.S. PATENT DOCUMENTS 4,126,335 11/1978 Voss ..... 285/39
4,552,387 11/1985 Schmidt ..... 285/282
5,090,747 2/1992 Kotake ..... 285/305
5,167,431 12/1992 Maifredi ..... 285/319
5,297,735 3/1994 Heimann et al. ..... 239/120
5,613,638 3/1997 Blessing ..... 239/396

*Primary Examiner*—Andres Kashnikow
*Assistant Examiner*—Lisa Ann Douglas

[57] ABSTRACT

A hand-held shower comprises a handle through the interior of which the water supply to the shower head is effected, the connection fitting for the shower hose is held in an axially displaceable manner: in a first axial position, the connection fitting is freely rotatable relative to the handle so that the shower hose connected to the hand-held shower is prevented from twisting. In the second axial position of the connection fitting, the free rotatability relative to the handle is suspended by a form closure.

10 Claims, 3 Drawing Sheets

HAND-HELD SHOWER

BACKGROUND OF THE INVENTION

The invention relates to a hand-held shower.

A shower is known having (a) a shower head with a plurality of water outlet openings, (b) a hollow handle, which is connected to the shower head and through the interior of which the water supply to the shower head is effected, (c) a connection fitting, which is freely rotatable on the end of the handle relative to said handle and to which the end of a shower hose is attachable, and (d) a device, by means of which the rotatability of the connection fitting relative to the handle may be suspended.

When such a shower after use is replaced into its holding device, it may happen that it is replaced in a position which is rotated relative to the original position. If such rotation occurs more frequently, the shower hose connected to the hand-held shower becomes twisted, which may lead to mechanical loading of the shower hose, an unattractive appearance and obstruction of the flow of water through the shower hose. For this reason, it is known to connect the shower hose in a freely rotatable manner to the handle of the hand-held shower. This may be effected in two different ways:

Firstly, it is possible to make the connection fitting of the shower hose freely rotatable relative to said hose. This has the drawback that the shower hose, which in the course of its period of service is more susceptible to damage, includes the relatively costly connection fitting construction which, if need be, has to be exchanged along with the shower hose.

Secondly, the shower hose may be rotatably connected to the handle, in which case the rotatable connection fitting is situated on the handle of the hand-held shower. In this case, it is necessary to ensure that the free rotatability of the connection fitting is suspended for the purpose of screwing the shower hose onto the hand-held shower because, otherwise, it would be impossible to screw the connection thread of the shower hose onto the connection thread of the hand-held shower. To this end, in known rotatable connection fittings integrated into a hand-held shower, a surface for applying a spanner is provided in the region of the connection fitting projecting axially beyond the handle. The spanner surface however lengthens the axially projecting region of the connection fitting and, after the shower hose has been fitted, leaves behind a clearly visible gap between the end face of the handle and the fitted shower hose.

SUMMARY OF THE INVENTION

The object of the present invention is to refine a hand-held shower of the type described initially in such a way that, without providing a visually unattractive spanner surface, the free rotatability of the connection fitting relative to the handle may be suspended.

Accordingly, the invention provides a shower comprising (a) a shower head with a plurality of water outlet openings, (b) a hollow handle, which is connected to the shower head and through the interior of which the water supply to the shower head is effected, (c) a connection fitting, which is freely rotatable on the end of the handle relative to said handle and to which the end of a shower hose is attachable, and (d) a device, by means of which the rotatability of the connection fitting relative to the handle may be suspended, in which the connection fitting is axially displaceable relative to the handle between two positions, namely (i) a first position, in which it is in a known manner freely rotatable relative to the handle; and (ii) a second position, in which the free rotatability is suspended by means of a form closure with the handle.

According to the invention, therefore, the connection fitting is situated normally, i.e. in the completely assembled state of the hand-held shower, in the first position in which the rotatability relative to the handle is guaranteed. Then, if the shower hose is to be removed or screwed for the first time or, in the case of exchange, once more onto the connection fitting, the latter is moved into the second axial position. In said position, a form closure with the handle prevents the connection fitting from being rotatable (optionally beyond a specific angle) relative to the handle. After assembly of the shower hose, the connection fitting is returned into the first position so that the now fastened shower hose is freely rotatable relative to the hand-held shower.

Preferably, the second axial position of the connection fitting lies further inside the handle than the first axial position. This means that, for "latching" of the connection fitting onto said handle, an axial pressure has to be exerted in an inward direction (relative to the interior of the handle of the shower).

Preferably a spring device is provided which loads the connection fitting towards the first position. The connection fitting then always automatically returns into the axial position in which free rotatability is guaranteed.

Preferably, the spring device is formed by at least one spring lug, which is integrally formed on the connection fitting and supported against a stationary radial surface inside the handle. In this way, when the connection fitting is manufactured, the spring device may be simultaneously produced "cost-free". This applies particularly when, as is often the case, the material of the connection fitting is plastic material.

Preferably, the form closure in the second position is formed by at least one rotary stop projecting from the external contour of the connection fitting and by at least one rotary stop projecting from the contour of the guide bore of the stationary holding part, in which the connection fitting is held. Given this refinement, the connection fitting in the second position also may still be rotated in each case through a specific angle relative to the handle until the cooperating rotary stops come into mutual contact. Owing to the fact that there is a plurality of such rotary stops distributed at specific angular intervals over the periphery of the connection fitting and the guide bore, it is possible to keep the angle, through which the connection fitting may still be rotated, within specific limits. The "residual rotatability" of the connection fitting in the second position thereby produced has the advantage that the connection fitting may more easily be moved axially into the second position since it is not necessary for that purpose to seek out a precisely defined angular position of the connection fitting.

For assembly reasons, it is advantageous if the holding part is a part which is initially separate from the handle and subsequently fastened in said handle. In this case, the holding part and the connection fitting are assembled outside the handle into a structural unit which, only then, is fastened as a whole in the handle.

This in turn is advantageously effected in that the holding part is fastened in an insert, which in turn is introduced from the free end of the handle into the interior of the handle and fixed there.

Fixing of the insert inside the handle is effected in an advantageous refinement of the invention in that there are formed on the insert at least two spring lugs, which upon introduction of the insert into the interior of the handle are initially compressed and upon attainment of the assembly position of the insert expand elastically and latch. Assembly of the insert and the holding part fastened thereto as well as of the guide part inside the handle may therefore be effected within seconds.

The mounting of the connection fitting in a rotatable and axially displaceable manner is effected in an advantageous embodiment of the invention in that the guide bore of the holding part has a region of a reduced diameter, which matches the outside diameter of a region of reduced diameter of the connection fitting, the axial length of the region of reduced diameter of the guide bore being smaller than the axial length of the region of reduced diameter of the connection fitting. By virtue of the difference between the two axial lengths, it is possible to displace the connection fitting axially relative to the holding part. The rotational guidance of the connection fitting inside the guide bore is then effected in each case in the region of reduced diameter of the said two parts.

Again for assembly reasons, it can be preferred for the enlarged region of the connection fitting projecting inwards beyond the holding part is formed by two diametrically opposed segments extending only over a specific angle, such that the cross-sectional shape of the enlarged region has, in one direction only, a dimension which is greater than the region of reduced diameter of the guide bore of the holding part, and the end region of the connection fitting lying in the interior of the handle is divided by a slot, which is positioned in the direction of the smallest dimension of the cross-sectional shape of the enlarged region of the connection fitting. In that case, it is possible for the slotted inner end region of the connection fitting to be elastically compressed in such a way that the innermost, enlarged end region of the connection fitting is brought to a dimension enabling it to be pushed through the region of reduced diameter of the guide bore. Having exited from the region, it then expands elastically once more, with the result that the connection fitting is then fixed on the holding part.

INTRODUCTION OF THE DRAWING

DESCRIPTION OF PREFERRED EMBODIMENTS

Figure 1:
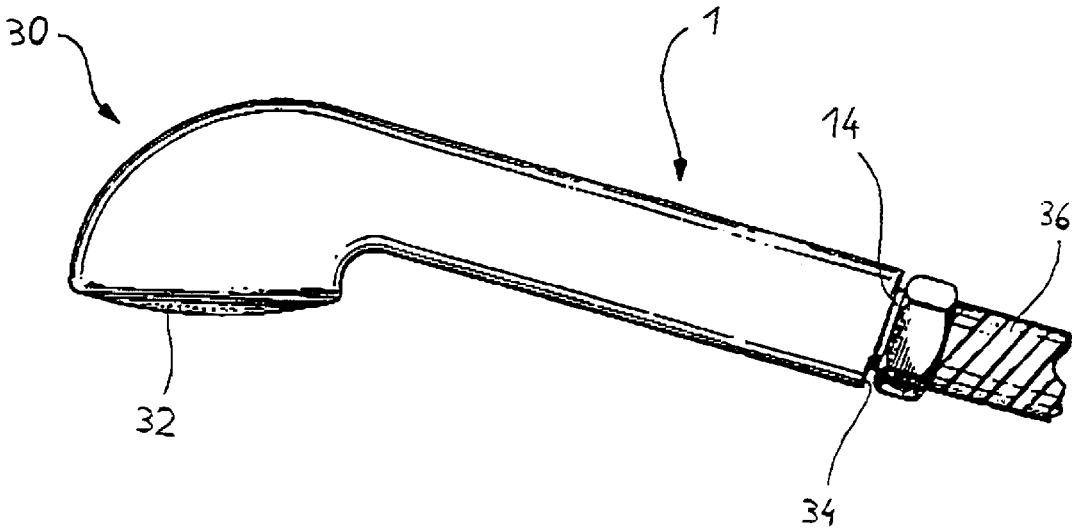
FIG. 1 shows a perspective view of a shower head which is attached to a shower hose.

FIG. 1 shows a shover head 30, comprising a plurality of water outlet openings 32, and a handle 1, having an 34 to which a fastening fitting 14 is connected. In a known manner, the handle is slightly curved. The incoming water is directed through a shower hose 36, which is connected to the fastening fitting 14 and through the handle 1 to the shower head 30.

Figure 2:
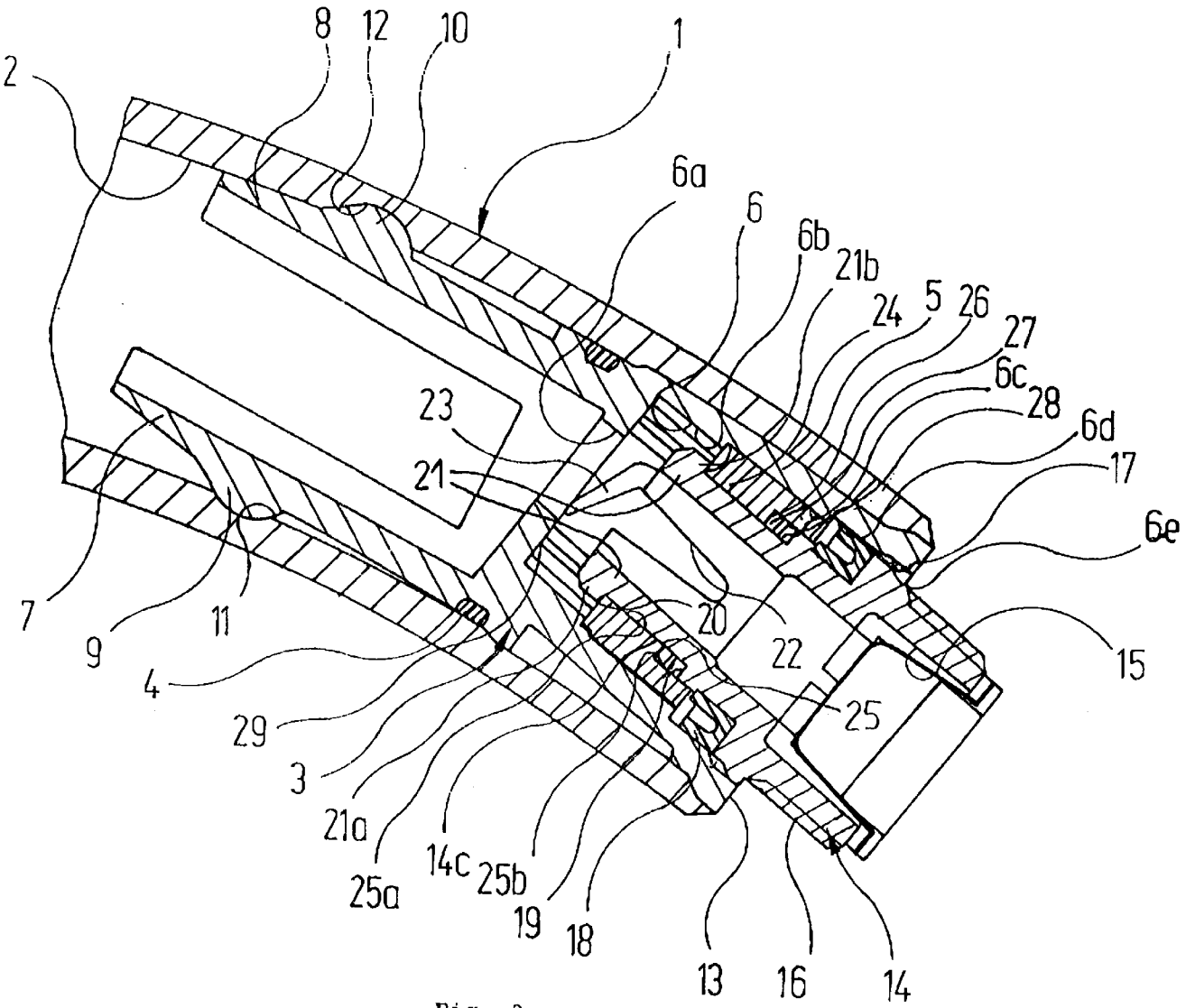
FIG. 2 shows the hose end of the handle of the hand-held shower with a connection fitting in a first position relative to the handle.

Referring now to FIG. 2, inserted from the free end 34 into an interior 2 of the handle 1 of the hand-held shower is an insert 3, the external contour of which is adapted to the internal contour of the interior 2 of the handle 1. An O-ring 4 lying in the peripheral surface of the insert 3 seals off the insert 3 from the handle 1.

The insert 3 comprises a main part 5 which, apart from the changes required for adaptation to the internal contour of the handle 1, is substantially cylindrical and has a multi-stepped bore 6 opening in an outward direction at the end of the handle 1.

Two spring lugs 7, 8 are integrally formed in a fork-like manner on the main part 5 of the insert 3, the external contour as before being maintained in such a manner that allows the entire insert 3 to be inserted into the interior 2. Situated on the outer surfaces of the spring lugs 7, 8 is in each case a detent nose 9, 10 which cooperates with a recess 11, 12 in the inner wall of the handle 1. Upon insertion of the insert 3 into the interior 2 of the handle 1, the spring lugs 7, 8 are initially slightly compressed so that the detent noses 9 and 10 slide along the inner wall of the handle 1. As soon as the detent noses 9 and 10 have reached the recesses 11 and 12 inside the handle 1, the spring lugs 7, 8 spring apart and the detent noses 9 and 10 engage into the recesses 11 and 12. In said manner, the insert 3 finds its axial support inside the handle 1.

The bore 6 of the main part 5 of the insert 3 has a centre line extending at right angles to the annular outer end face 13 of the insert 3. Thus, the shower hose to be fastened to the handle 1 of the hand-held shower continues the contour of the handle 1 in a break-free manner.

The central bore 6 has, from the inside towards the outside, regions 6*a*, 6*b*, 6*c*, 6*d* and 6*e*, the diameter of which increases in the indicated order. The various regions 6*a* to 6*e* of the central bore 6 of the housing serve, in a manner yet to be described, to receive and fix a fastening fitting 14 for the shower hose, which is rotatable but arrestable in its rotational movement, as well as to direct the water into the interior 2 of the handle 1.

The fastening fitting 14 is a substantially cylindrical part with a multi-stepped external contour and with an inner bore 15, the centre line of which extends coaxially relative to the central bore 6 of the insert 3.

The fastening fitting 14, on the outer lateral surface of the region projecting beyond the handle 1 of the hand-held shower, comprises a fastening thread 16 on which the shower hose (not shown) is fitted. An annular shoulder 17 lies with its outer lateral surface in the outermost region 6*e* of the inner bore 6 of the insert 3. The axial length of the shoulder 17 is shorter than the axial length of the region 6*e*, with the result that the entire fastening fitting 14 is axially displaceable to a specific extent.

In the region 6*d* of the central bore 6 of the insert 3, the external contour of the fastening fitting 14 is set back to a smaller diameter in such a way as to leave an annular space between the bore region 6*d* and the fastening fitting 14. Inserted in said annular space is a formed gasket 18 which seals off the external contour of the fastening fitting 14 from the central bore 6 of the insert 3.

Continuing once more inwards in an axial direction, the external contour of the fastening fitting 14 verges via a radial step 19 into a region 14*c* of even smaller diameter. At the innermost end, the external contour of the fastening fitting 14 widens via a further radial step 20 into an annular collar 21, which again has a larger diameter. The annular collar 21 however extends not over the entire periphery of the fastening fitting 14 but only over a specific angle on, in each case, opposing sides. The end result is two ring-segment-shaped or sickle-shaped regions 21*a* and 21*b* of the annular collar. The significance of said division of the annular collar 21 is explained further below.

The fastening fitting 14 from its inner-lying end up to approximately the axial height of the peripheral step 19 is split by a slot 22 into two opposing halves in such a way as to enable said halves to bend resiliently towards one another.

Finally, there are formed on the inner-lying end face of the fastening fitting 14 two spring lugs 23 (one of which is visible in the drawing), which are supported by their free end against the radial step 29 of the insert 3 formed between the bore regions 6*a* and 6*b*.

The fastening fitting 14 is held in a rotatable and axially displaceable manner in the insert 3 by means of an annular fastening part 24, which is glued or welded by its outer lateral surface in the region 6*c* of the central bore 6. The fastening part 24 has a central bore 25 with a region 25*a* of smaller diameter and a region 25*b* of greater diameter. A radially extending step 26 lies between the regions 25*a* and 25*b*. The diameter of the bore region 25*a* matches the outside diameter of the region 14*c* of the fastening fitting 14; the diameter of the bore region 25*b*, on the other hand, corresponds to the outside diameter of the fastening fitting 14 axially outside of the peripheral step 19. The axial length of the bore region 25*a* of the fastening part 24 is shorter than the axial length of the region 14*c* of the fastening fitting 14, with the result that the fastening fitting 14 is axially displaceable to a specific extent inside the bore 25 of the fastening part 24.

Formed on the step 19 of the fastening fitting 14 and distributed over the periphery is a plurality of axially projecting (relative to the region 14*c*, radially projecting) rotary stops 28. In a corresponding manner, there is formed on the step 26 of the fastening part 24 and distributed over the periphery a plurality of axially projecting (relative to the bore region 25*b*, radially projecting) rotary stops 27.

Assembly of the hand-held shower described above is effected as follows:

First, the shaped gasket 18 is drawn onto the corresponding peripheral region of the fastening fitting 14. Then, the inner-lying axial region of the fastening fitting 14, which is divided by the slot 22 into two halves, is compressed in such a way that said inner-lying region of the fastening fitting 14 may be introduced through the central bore 25 of the fastening part 24 until the annular collar segments 21*a* and 21*b*, after passing through the bore 25, may spring apart again. Thus, the fastening fitting 14 is now fastened in an axially displaceable and rotatable manner to the fastening part 24.

In the next stage, the structural unit comprising the fastening fitting 14 and the fastening part 24 is fitted in the insert 3.

To said end, the fastening part 24 is simply inserted into the region 6*c* of the inner bore of the insert 3, where it is glued or welded firmly in position. Since the spring lugs 23 of the fastening fitting 14 are then supported against the step 29 between the bore regions 6*a* and 6*b*, the fastening fitting 14 is resiliently pushed axially as far outwards as possible. In said position, the rotary stops 28 and 27 on the fastening part 24 and the fastening fitting 14 respectively are at an axial distance from one another, in the manner shown in the drawing.

In the final assembly stage, the structural unit now comprising the insert 3, the fastening part 24 and the fastening fitting 14 is inserted into the interior 2 of the handle 1 of the hand-held shower, where it is fixed by latching in the manner already described above.

Figure 3:
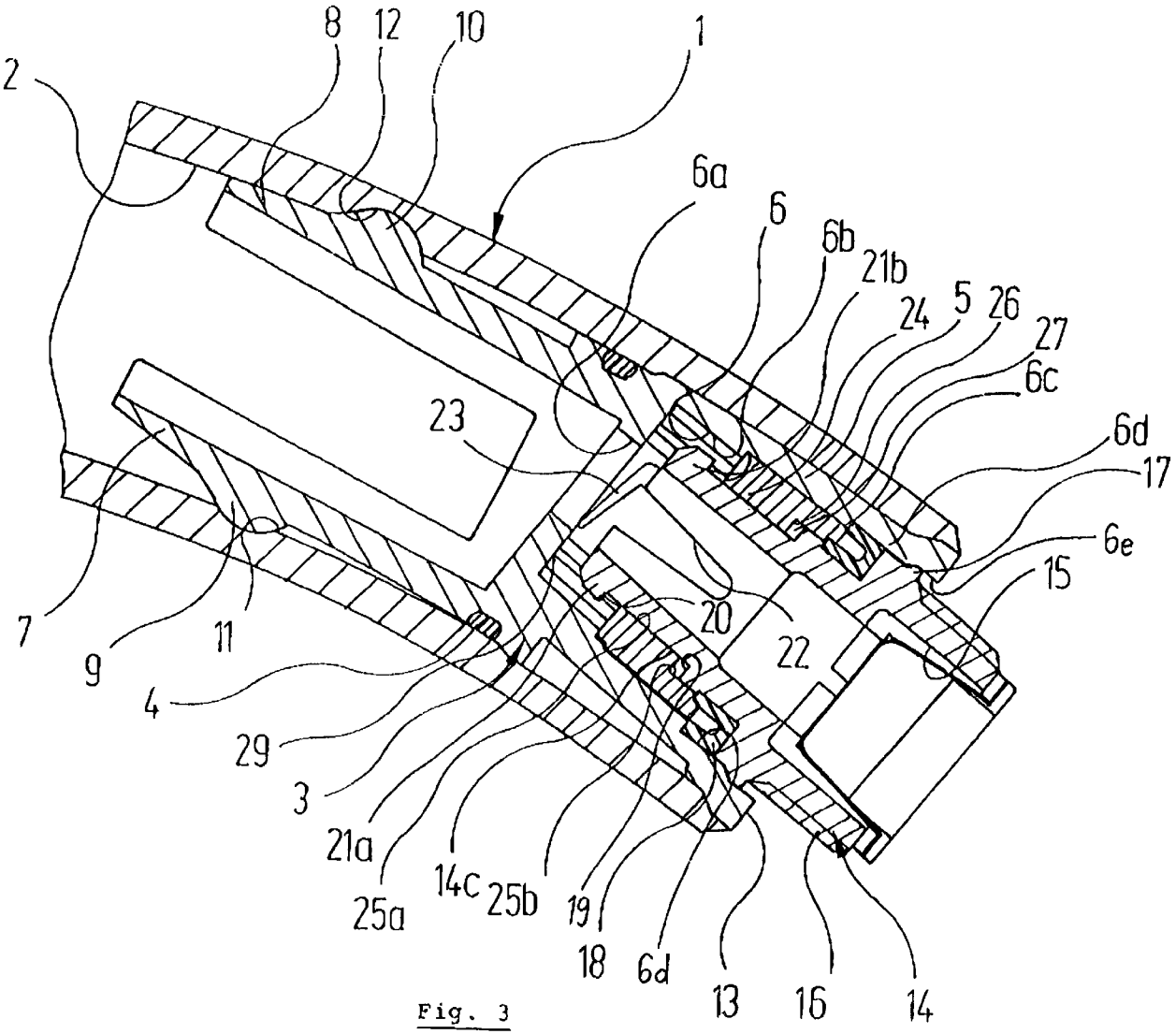
FIG. 3 shows a view similar to FIG. 2 with the connection fitting in a second position relative to the handle.

Assembly of the shower hose on the fastening thread 16 of the fastening fitting 14 is effected as follows (FIG. 3):

The connection thread of the shower hose, which is complementary to the fastening thread 16 of the fastening fitting 14, is placed on the fastening fitting 14. To prevent the fastening fitting 14 from rotating freely inside the fastening part 24 (which because of the axial distance of the rotary stops 28, 27 is initially possible), i.e. to enable a relative rotation to occur between the connection thread of the shower hose and the connection thread 16 of the fastening fitting 14, pressure is exerted on the shower hose so that the fastening fitting 14 is pressed axially inwards. This occurs with simultaneous elastic deformation of the spring lugs 23 of the fastening fitting 14. The rotary stops 28 of the fastening fitting 14 therefore move into the axial region of the rotary stops 27 of the fastening part 24 so that they mutually engage and suspend a rotation of the fastening fitting 14 relative to the fastening part 24 and hence relative to the handle 1 of the hand-held shower. The connection thread of the shower hose may then be screwed fully onto the connection thread 16 of the fastening fitting 14. Once this has occurred, the shower hose is let go; the spring lugs 23 of the fastening fitting 14 once more push the fastening fitting 14 inside the fastening part 24 axially outwards into the position shown in the drawing, in which the rotary stops 28 and 27 are disengaged. The fastening fitting 14 may then rotate freely in the desired manner relative to the handle 1.

What is claimed is:

1. A hand-held shower comprising:

(a) a shower head with a plurality of water outlet openings;

(b) a hollow handle, which is connected to the shower head and through the interior of which the water supply to the shower head is effected;

(c) a connection fitting, which is freely rotatable on the end of the handle relative to said handle and to which the end of a shower hose is attachable;

(d) a device, by means of which the rotatability of the connection fitting relative to the handle may be suspended, in which the connection fitting is axially displaceable relative to the handle between two positions, namely (i) a first position, in which it is in a known manner freely rotatable relative to the handle; and (ii) a second position, in which the free rotatability is suspended by means of a form closure with the handle.

2. Hand-held shower according to claim 1, in which the second axial position of the connection fitting lies further inside the handle than the first axial position relative to a free end of the handle 1.

3. A hand-held shower as claimed in claim 1, in which a spring device is provided, which loads the connection fitting towards the first position.

4. A hand-held shower as claimed in claim 3, in which the spring device is formed by at least one spring lug, which is integrally formed on the connection fitting and is supported against a stationary radial surface inside the handle.

5. Hand-held shower according to claim 1, further comprising a stationary holding part (24) for guiding the connection fitting (14) in which the form closure in the second position of the connection fitting (14) is formed by at least one rotary stop (28) projecting from an external contour of the connection fitting (14) and by at least one rotary stop (27) projecting from a contour of a guide bore (25) of the stationary holding part (24).

6. A hand-held shower as claimed in claim 5, in which the holding part is a part which is initially separate from the handle and subsequently fastened in said handle.

7. A hand-held shower as claimed in claim 6, in which the holding part—is fastened in an insert, which in turn is introduced from the free end of the handle into the interior of the handle and fixed thereto.

8. A hand-held shower as claimed in claim 7, in which there are formed on the insert at least two spring lugs, which upon introduction of the insert into the interior of the handle are initially compressed and upon attainment of the assembly position of the insert expand elastically and latch.

9. A hand-held shower as claimed in claim 1, in which the guide bore of the holding part has a region of a reduced diameter, which matches the outside diameter of a region of reduced diameter of the connection fitting, the axial length of the region of reduced diameter of the guide bore being smaller than the axial length of the region of reduced diameter of the connection fitting.

10. A hand-held shower as claimed in claim 1, in which the enlarged region of the connection fitting projecting inwards beyond the holding part is formed by two diametrically opposed segments extending only over a specific angle, such that the cross-sectional shape of the enlarged region has, in one direction only, a dimension which is greater than the region of reduced diameter of the guide bore of the holding part, and that the end region of the connection fitting lying in the interior of the handle is divided by a slot, which is positioned in the direction of the smallest dimension of the cross-sectional shape of the enlarged region of the connection fitting.

* * * * *